US008910714B2

(12) United States Patent
Tardy et al.

(10) Patent No.: US 8,910,714 B2
(45) Date of Patent: Dec. 16, 2014

(54) METHOD FOR CONTROLLING THE DOWNHOLE TEMPERATURE DURING FLUID INJECTION INTO OILFIELD WELLS

(75) Inventors: Philippe M. J. Tardy, Gannat (FR); Douglas Pipchuk, Calgary (CA); Xiaowei Weng, Katy, TX (US); Fernando Baez Manzanera, Doral, FL (US)

(73) Assignee: Schlumberger Technology Corporation, Sugar Land, TX (US)

( * ) Notice: Subject to any disclaimer, the term of this patent is extended or adjusted under 35 U.S.C. 154(b) by 307 days.

(21) Appl. No.: 12/977,720

(22) Filed: Dec. 23, 2010

(65) Prior Publication Data

US 2012/0160496 A1 Jun. 28, 2012

(51) Int. Cl.

| | |
|---|---|
| ***E21B 43/26*** | (2006.01) |
| ***E21B 19/00*** | (2006.01) |
| ***E21B 47/00*** | (2012.01) |
| ***E21B 43/16*** | (2006.01) |
| ***E21B 47/06*** | (2012.01) |

(52) U.S. Cl.

CPC ..... *E21B 43/16* (2013.01); *E21B 47/065* (2013.01)

USPC ..... 166/305.1; 166/90.1; 166/250.01

(58) Field of Classification Search

CPC ..... E21B 43/25; E21B 43/164; E21B 34/14

USPC ..... 166/305.1, 90.1, 261, 402, 250.01

See application file for complete search history.

(56) References Cited

U.S. PATENT DOCUMENTS

| | | | | |
|---|---|---|---|---|
| 5,597,042 | A * | 1/1997 | Tubel et al. | 166/250.01 |
| 6,281,489 | B1 | 8/2001 | Tubel et al. | |
| 6,758,271 | B1 * | 7/2004 | Smith | 166/250.1 |
| 6,789,621 | B2 | 9/2004 | Wetzel et al. | |
| 6,789,937 | B2 * | 9/2004 | Haddad et al. | 374/136 |
| 6,826,954 | B2 * | 12/2004 | Brown | 73/204.13 |
| 6,851,444 | B1 * | 2/2005 | Kohl et al. | 137/13 |
| 6,981,553 | B2 * | 1/2006 | Stegemeier et al. | 166/300 |
| 7,040,390 | B2 * | 5/2006 | Tubel et al. | 166/64 |
| 7,234,524 | B2 * | 6/2007 | Shaw et al. | 166/304 |
| 7,240,547 | B2 | 7/2007 | Brown | |

(Continued)

OTHER PUBLICATIONS

A New Equation of State for Carbon Dioxide Covering the Fluid Region from the Triple-Point Temperature to 110 K at Pressures up to 800 MPa. R. Span and W. Wagner. J. Phys. Chem. Ref. Data, vol. 25, No. 6, 1996. pp. 1509-1596.

(Continued)

*Primary Examiner* — Kenneth L Thompson
*Assistant Examiner* — Michael Wills, III
(74) *Attorney, Agent, or Firm* — Michael L. Flynn; Timothy Curington; Robin Nava

(57) ABSTRACT

Methods and apparatus for using a fluid within a subterranean formation comprising forming a fluid comprising a fluid additive, introducing the fluid to a formation, observing a temperature, and controlling a rate of fluid introduction using the observed temperature, wherein the observed temperature is lower than if no observing and controlling occurred. A method and apparatus to deliver fluid to a subterranean formation comprising a pump configured to deliver fluid to a wellbore, a flow path configured to receive fluid from the pump, a bottom hole assembly comprising a fluid outlet and a temperature sensor and configured to receive fluid from the flow path, and a controller configured to accept information from the temperature sensor and to send a signal.

18 Claims, 6 Drawing Sheets

(56) References Cited

U.S. PATENT DOCUMENTS

| | | | | |
|---|---|---|---|---|
| 7,243,726 | B2 * | 7/2007 | Ohmer | 166/304 |
| 7,389,787 | B2 * | 6/2008 | Means et al. | 137/13 |
| 7,448,448 | B2 * | 11/2008 | Lovell et al. | 166/279 |
| 8,230,915 | B2 * | 7/2012 | Weng | 166/250.01 |
| 2002/0027004 | A1 * | 3/2002 | Bussear et al. | 166/250.15 |
| 2004/0168811 | A1 * | 9/2004 | Shaw et al. | 166/368 |
| 2006/0096760 | A1 * | 5/2006 | Ohmer | 166/304 |
| 2006/0196659 | A1 | 9/2006 | Jee et al. | |
| 2007/0068672 | A1 * | 3/2007 | Jalali et al. | 166/250.01 |
| 2007/0289740 | A1 * | 12/2007 | Thigpen et al. | 166/250.01 |
| 2008/0041594 | A1 * | 2/2008 | Boles et al. | 166/305.1 |
| 2008/0262737 | A1 * | 10/2008 | Thigpen et al. | 702/9 |
| 2008/0289408 | A1 * | 11/2008 | Adnan et al. | 73/152.12 |
| 2009/0023614 | A1 | 1/2009 | Sullivan et al. | |
| 2009/0090504 | A1 * | 4/2009 | Weightman et al. | 166/250.01 |
| 2009/0173494 | A1 * | 7/2009 | Tarvin et al. | 166/250.15 |
| 2009/0294123 | A1 * | 12/2009 | Mescall et al. | 166/250.01 |
| 2009/0308613 | A1 * | 12/2009 | Smith | 166/305.1 |
| 2010/0006292 | A1 * | 1/2010 | Boles et al. | 166/305.1 |
| 2011/0067882 | A1 * | 3/2011 | Yeriazarian et al. | 166/369 |
| 2011/0073295 | A1 * | 3/2011 | Steele et al. | 166/53 |
| 2011/0226469 | A1 * | 9/2011 | Lovell et al. | 166/250.01 |
| 2011/0277996 | A1 * | 11/2011 | Cullick et al. | 166/250.12 |
| 2011/0288843 | A1 * | 11/2011 | Weng et al. | 703/10 |
| 2011/0301848 | A1 * | 12/2011 | Garcia et al. | 702/6 |
| 2012/0003013 | A1 * | 1/2012 | Sakamoto et al. | 399/258 |
| 2012/0018167 | A1 * | 1/2012 | Konopczynski et al. | 166/369 |
| 2012/0073799 | A1 * | 3/2012 | Kim et al. | 166/57 |
| 2012/0132425 | A1 * | 5/2012 | Kim et al. | 166/302 |

OTHER PUBLICATIONS

Joule-Thomson effect—From Wikipedia, the free encyclopedia: http://en.wikipedia.org/wiki/Joule%E2%80%93Thomson_effect Downloaded Apr. 25, 2011.

Production Logging—Theoretical and Interpretive Elements—A.D. Hill, Assoc Professor U. of Texas, SPE Monograph vol. 4, Henry L. Doherty Series, 1990, Richardson Texas 1990. pp. 19-36.

Reservoir Stimulation, Third Edition. Michael J. Economides and Kenneth G. Nolte, Editors.John.VViley & Sons Ltd. Chapter 16, pp. 25 and 26 (16-25, 16-26).

SPE77521—A Case History on the Use of Down-hole Sensors in a Field Producing from Long Horizontal/Multilateral Wells. Thomas F. Clancy, Jairo Balcacer, Sebastian Scalabre, George Brown, Paul O'Shaughnessey, Ricardo Tirado and Greg Davie. Copyright 2002, Society of Petroleum Engineers, Inc. Prepared for presentation at the SPE Annual Technical Conference and Exhibition held in San Antonio, Texas, Sep. 29-Oct. 2, 2002.

* cited by examiner

METHOD FOR CONTROLLING THE DOWNHOLE TEMPERATURE DURING FLUID INJECTION INTO OILFIELD WELLS

FIELD

The invention relates to methods to control the delivery of fluids for use in oilfield applications for subterranean formations. More particularly, the invention relates to controlling the fluid temperature.

BACKGROUND

The statements in this section merely provide background information related to the present disclosure and may not constitute prior art.

This invention relates to fluids used in treating a subterranean formation. The pumping of treatment fluids, such as acids or other types of fluids and chemicals is routinely conducted in oil and gas production wells and in water injection wells to enhance either hydrocarbon production or water injection. During the injection of the treatment, the fluids flow down the wellbore and reach the target geological zones at a certain downhole injection temperature which depends on many factors such as the surface temperature, the initial geothermal profile between the surface and downhole, the pump rate, the geometry of the wellbore and the thermal properties of the fluids, completion materials, and rocks in the subterranean formations. Control of the downhole injection temperature is desirable to efficiently tailor the effectiveness and other parameters of the treatment.

SUMMARY

Embodiments of the invention provide methods and apparatus for using a fluid within a subterranean formation comprising forming a fluid comprising a fluid additive, introducing the fluid to a formation, observing a temperature, and controlling a rate of fluid introduction using the observed temperature, wherein the observed temperature is lower than if no observing and controlling occurred. Embodiments of the invention provide methods and apparatus to deliver fluid to a subterranean formation comprising a pump configured to deliver fluid to a wellbore, a flow path configured to receive fluid from the pump, a bottom hole assembly comprising a fluid outlet and a temperature sensor and configured to receive fluid from the flow path, and a controller configured to accept information from the temperature sensor and to send a signal.

DETAILED DESCRIPTION

Figure 1:
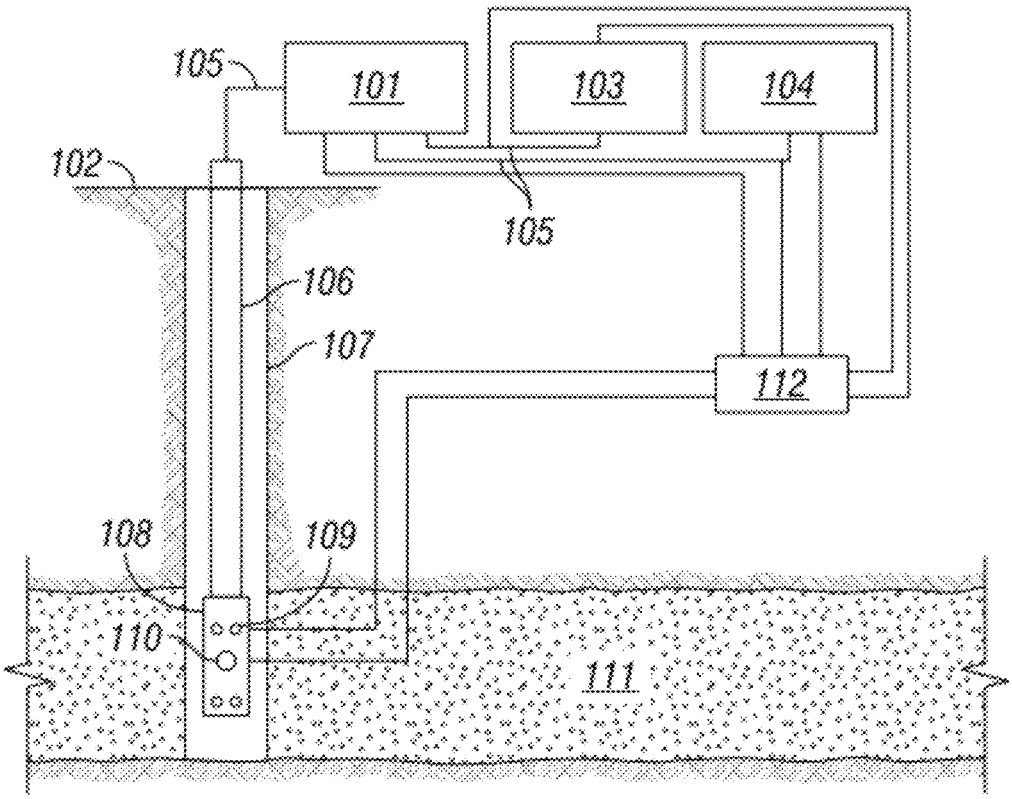
FIG. 1 is a schematic diagram of surface equipment and a bottom hole assembly.

The procedural techniques for pumping fluids down a wellbore to fracture a subterranean formation are well known. The person that designs such treatments is the person of ordinary skill to whom this disclosure is directed. That person has available many useful tools to help design and implement the treatments, including computer programs for simulation of treatments.

In the summary of the invention and this description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific numbers, it is to be understood that inventors appreciate and understand that any and all data points within the range are to be considered to have been specified, and that inventors have disclosed and enabled the entire range and all points within the range. All percents, parts, and ratios herein are by weight unless specifically noted otherwise.

Temperature control along a surface of a subterranean formation is important when acid is injected into the reservoir rock around the wellbore to increase production rate. The acid efficiency depends on the acid temperature and it may be desirable to decrease the downhole injection temperature to ensure better acid performance. Another example is the determination of the geological zones that are accepting the injected fluid and those that are not which may be achieved by using distributed temperature sensors (DTS). If the downhole injection temperature is sufficiently low/high, then zones of higher injectivity will show larger warmback/cooldown times if the well is shut in after the treatment. The warmback/cooldown time is the time it takes during the shut-in for the temperature of a given zone to come back to its original value before treatment. The measure of the warmback/cooldown time becomes more accurate if the downhole injection temperature is lower/higher than otherwise achieved.

One means of changing the downhole injection temperature is to expose the fluid to a pressure drop caused by fluid expansion. The laws of thermodynamics predict that, under such a process, fluids may either reduce or increase their temperature through an effect named the Joule Thomson (JT) effect. Embodiments of the invention relate to a method of controlling downhole injection temperature by taking advantage of this effect through the combined use of pump rate, a bottom hole assembly (BHA), additives to the fluids and downhole temperature sensors.

For certain types of applications, the functionality and the performance of the injected fluid may depend on the downhole injection temperature. In other types of applications, it may be desirable to modify the downhole injection temperature in such a way that some downhole measurements used for interpreting the treatment fluid performance may be optimized. The JT effect and its influence on the downhole temperature during the production of reservoir fluids have been investigated by many authors. However, the controlled use of the JT effect to accomplish the goal of changing the downhole injection temperature of the injected fluid for a given purpose has not been pursued historically.

Historically, a method changes the temperature of the fluid in the wellbore using the JT effect of a gas that would change the temperature of a heat exchanger. The wellbore fluid flowing in contact with the heat exchanger would have its temperature changed by heat transfer between the heat exchanger and the wellbore fluid. The method proposed here is significantly different as it uses the JT effect of the injected fluid itself and therefore does not require a heat exchanger. Historical methods do not deal with changing the downhole injection temperature to control the functionality of the injected fluid and only measure its properties.

The JT effect can occur during the production of a gas when the later experiences a significant pressure drop when going from the reservoir rock into the well. In most situations, the gas will experience a temperature drop during the pressure drop. This temperature drop may be detected by downhole temperature gages, such as those on production logging tools or distributed temperature sensors and may help an engineer identify the regions along the wellbore from which gas is being produced. Additionally, as the gas moves up to the surface production facility, its pressure will decrease and the JT effect will often result in a reduced gas temperature.

Additional embodiments of the invention control a temperature change during injection, into the well through the JT effect. Methods comprise using a tool and a control process which can be used for changing the downhole injection temperature through the JT effect during the pumping of a fluid treatment in a well.

If it is estimated or known by measurement that the fluid being pumped for a specific purpose, such as reservoir stimulation, chemical treatment, and enhanced oil recovery, does not have the required downhole injection temperature, either for its own performance or for the accuracy of the downhole temperature-based interpretation of the treatment performance, placing a device along its flow path will cause a pressure drop in the fluid. This pressure drop will change the downhole injection temperature through the JT effect. By being able to measure or predict the down hole injection temperature and to control the pump rate, the down hole injection temperature may be adjusted to the required temperature. The down hole injection temperature response to the pump rate may also be enhanced by introducing fluid additives, such as gases, to the pumped fluid.

The method has two parts:

1. The Tool: The physical device and products that cause a change in the down hole injection temperature
2. The Control Process: The methodology for optimizing the use of the tool A down hole injection temperature change may be achieved by three means:

1. The characteristics of the bottom hole assembly
2. The value of the pump rate
3. The use of fluid additives For instance, the fluid may be pumped from the surface through a tubing or coiled-tubing at the end of which a bottom hole assembly may be placed. On the bottom hole assembly, a temperature sensor may be mounted. The ensemble formed by the pump, the flow path, typically the drill pipe or coiled tubing, the bottom hole assembly, the temperature sensor, and the fluid additives, is referred as the tool and is used as part of the method. The bottom hole assembly of the tool may have some remotely controlled flow devices or orifices which, for a given pump rate, may control the pressure drop that the fluid will undergo when leaving the bottom hole assembly into the wellbore before flowing into the reservoir. The down hole injection temperature may also be monitored using downhole temperature sensors not mounted on the bottom hole assembly. For instance, the down hole injection temperature may be measured using down hole temperature sensors deployed in the wellbore before or during the pumping. Finally, if down hole temperature sensors are not available, the down hole injection temperature may be predicted using a mathematical model capable of solving the relevant thermodynamics problem for the treatment fluid undergoing expansion through the controlled flow devices or orifices.

Figure 3:
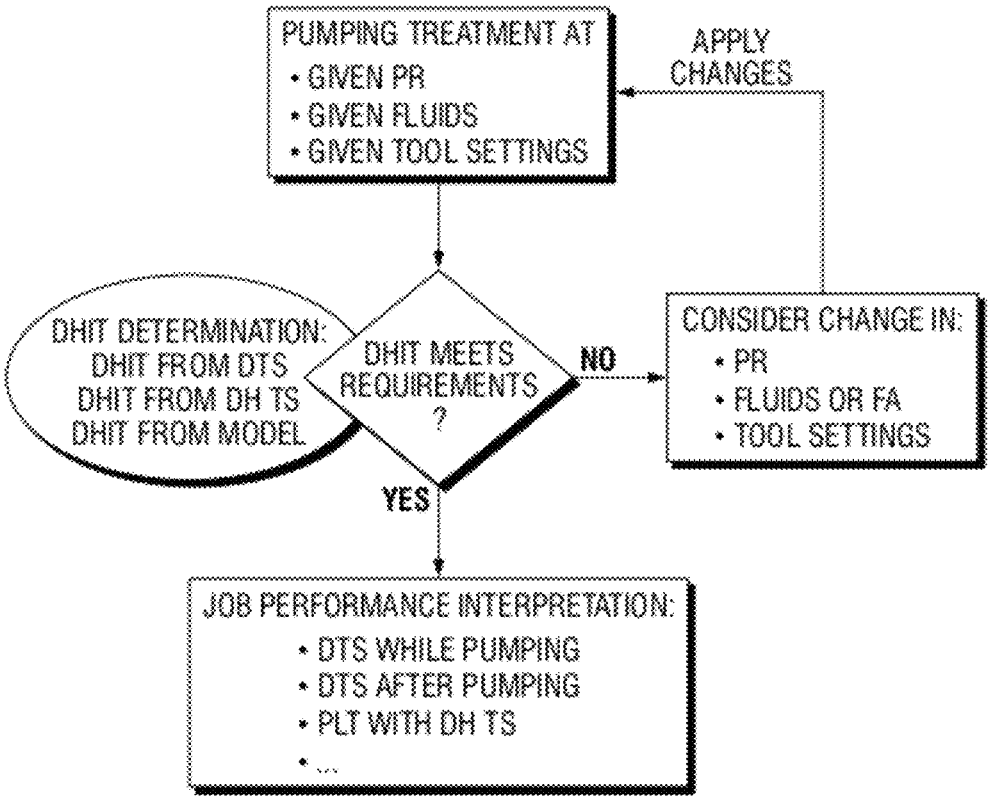
FIG. 3 is a flow diagram of a process of embodiments of the invention.

Using the down hole injection temperature data measured by the temperature sensors on the bottom hole assembly, or measured with other down hole temperature sensors, or predicted by the model, some adjustment of the pump rate and of the tool may be decided during the pumping. This decision tree is referred as the control process and is the second part of the method. It is illustrated in FIG. 3. For instance, the controlled flow devices may be valves which can be closed or open to increase or reduce the pressure drop. Additionally; the fluid additive may be a gas that is pumped with the fluid to optimize the value of the JT coefficient of the gas-fluid mixture. Alternatively, gas on its own may be pumped towards the end of the treatment for further control on the down hole injection temperature through increased JT effect.

A combined use of the tool and the control process will help engineers ensuring that the down hole injection temperature meets the requirements.

FIG. 1 illustrates one embodiment of the mechanical equipment that may be used. The pumping is performed using a fluid pump 101 on surface 102. The treatment fluid and the fluid additive are stored in their own fluid tanks 103 and 104 and flow through the pump 101 at a rate and proportion controlled by the engineer. The mixture, formed by the treatment fluid and the fluid additive, then flows through surface lines 105 and then down into the wellbore 107 through a flow path 106, typically production tubing, the casing, a drill pipe, or coiled tubing. At the end of the flow path 106, the fluid enters the bottom hole assembly 108. The bottom hole assembly 108 has multiple orifices 109 that may be closed or open remotely by the engineer. When flowing through an orifice, as represented in FIG. 3, the fluid undergoes a pressure drop. The extent of the pressure drop is controlled by the following.

The pump rate

The number of orifices open to flow

The amount of fluid additive

The pressure drop causes the fluid to undergo a change in down hole injection temperature as it leaves the bottom hole assembly 108 and flows into the reservoir 111. This change in down hole injection temperature may be monitored at the surface by using the temperature reading from temperature sensors 110 through wireline communication or fiber optic cable. Alternatively, the down hole injection temperature may be obtained by other down hole temperature sensors (not shown) such as a distributed temperature sensors or be predicted by a mathematical model. In any event, controller 112 may receive a signal from or send a signal to the bottom hole assembly, temperature sensor, pump, additive or fluid tanks, or lines connecting the tanks, pump, flow path, or assembly.

Finally, the engineer may change some of the above three parameters to optimize the down hole injection temperature.

Figure 2:
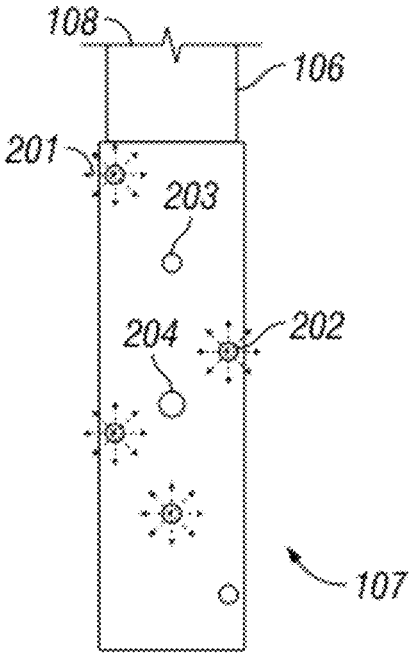
FIG. 2 is a schematic diagram of details of a bottom hole assembly.

FIG. 2 is a schematic diagram of details of a bottom hole assembly 108 in a wellbore 107. The fluid flows through the flow path 106 to the assembly 108 with a pressure drop illustrated by flow lines 201. FIG. 2 shows flow lines 201 are present on open valves 202, but not on closed valves 203. Temperature sensors 204 may also be placed across the surface of or embedded in or suspended near the assembly 108.

In the case where the down hole injection temperature must be controlled for the accuracy of the down hole temperature-based interpretation of the treatment performance, it is also possible to pump another fluid than the treatment fluid, on its own, in order to achieve the required down hole injection temperature. For instance, if it is estimated that, under the conditions under consideration, the down hole injection temperature may not be controlled by pumping the treatment fluid, another fluid may be pumped at some stages in order to achieve the required down hole injection temperature for some time and to allow more accurate interpretation. For instance, at the end of an acid treatment, a gas may be pumped after the acids to achieve a larger change on the down hole injection temperature. This larger change on the down hole injection temperature will allow a more accurate interpretation concerning the event associated with the gas injection, which may be a direct consequence of the treatment performance. For instance, after having pumped the acid, the inflow profile along the well is what determines the acid treatment performance. Pumping a gas after the acid, with an optimum down hole injection temperature will reveal the inflow profile during gas injection. The inflow profile during gas injection being a consequence of the performance of the acid, the acid performance may be estimated. After pumping the gas, the pump rate is set to zero and the well is shut-in while a distributed temperature sensor is logged. Looking at how fast the down hole temperature at a given depth warms back to the temperature before the treatment reveals how much was injected. Alternatively, the position of a gas slug, with a lower down hole injection temperature along the well may be monitored by distributed temperature sensors revealing which zones are accepting fluid during the pumping. The use of temperature logging such as distributed temperature sensors or a down hole temperature on a moving tool as a means to identify injectivity profiles based on a down hole injection temperature significantly different from the reservoir temperature is important to some embodiments.

The following thermodynamic calculations may be performed to determine the down hole injection temperature as a function of the above three parameters. These calculations validate the concept of the use of the JT effect and may be used as a means of predicting the down hole injection temperature change with the pressure drop. The value of the pressure drop that the fluid will undergo when flowing through the orifices can be determined using Equation (1) and Equation (2):

$$PD = \frac{1}{2c^2}(1-\beta^4)\rho_F(V)^2 \tag{1}$$

$$\beta = \frac{d_u}{d_o}, \quad V = \frac{PR}{A_d} = \frac{PR}{\frac{1}{4}n_o\pi d_0^2} \tag{2}$$

PD is the Pressure prop (Pa)

V is the fluid flow velocity (m/s)

c is the dimensionless discharge coefficient $d_u$ Is the upstream diameter (m)

$d_o$ is the orifice diameter (m)

$\rho_F$ is the fluid density (kg/m$^3$)

$A_d$ is the surface flow area formed by all $n_o$ open orifices (m$^2$)

$n_o$ is the number of orifices open to flow

If the fluid additive is a gas, the two fluids will undergo a different pressure drop, $PD_F$ for the treatment fluid and $PD_G$ for the gas, as described by Equation (3) and Equation $$PD_G = \frac{1}{2c^2}(1-\beta^4)\rho_G(Vq)^2. \tag{4}$$

$$PD_F = \frac{1}{2c^2}(1-\beta^4)\rho_F(V(1-q))^2 \tag{3}$$

$$PD_G = \frac{1}{2c^2}(1-\beta^4)\rho_G(Vq)^2 \tag{4}$$

q is the volume fraction of gas in the mixture formed by the fluid and the gas $\rho_G$ is the gas density (kg/m$^3$)

In the general case where the fluid additive is a gas, both fluids phases will undergo a change in down hole injection temperature, denoted DTF for the treatment fluid and DTG for the gas additive, as given by Equation (5) and Equation (6).

$$DT_F = \int_{BHP+DP_F}^{BHP} \eta_F(p, T_F)\,dp \tag{5}$$

$$DT_G = \int_{BHP+DP_G}^{BHP} \eta_G(p, T_G)\,dp \tag{6}$$

$DT_G$ is the temperature variation in the gas phase (K)

$DT_F$ is the temperature variation in the fluid phase (K)

$\eta_G$ is the gas Joule-Thomson coefficient (K/Pa)

$\eta_F$ is the treatment fluid Joule-Thomson coefficient (K/Pa)

BHP is the DH pressure in the wellbore (Pa)

$T_G$ is the temperature in the gas phase (K)

$T_F$ is the temperature in the fluid phase (K)

p is the pressure (Pa)

The final value of the down hole injection temperature of the mixture formed by the treatment fluid and the gas can be determined using Equation (7).

$$DHIT = T_I + DT_{GF} = T_I + \frac{q\rho_G C_{pG}(T_I + DT_G) + (1-q)\rho_F C_{pF}(T_I + DT_F)}{q\rho_G C_{pG} + (1-q)\rho_F C_{pF}} \tag{7}$$

DHIT is the DH Injection Temperature (K)

$DT_{GF}$ is the temperature variation of the mixture during the JT effect (K)

$C_{pG}$ is the heat capacity of the gas (J/(kg K))

$C_{pF}$ is the heat capacity of the fluid (J/(kg K))

$T_I$ is the initial temperature of the mixture in the BHA, before flowing through the orifices (K)

The physical and thermodynamic properties of the treatment fluid and the gas, $\rho_F$, $\rho_G$, $C_{pG}$, $C_{pF}$, $C_{pG}$, $\eta_F$, $\eta_G$, are functions of the temperature and pressure. It is possible to determine those properties from an equation of state. An equation of state links the value of the fluid density, fluid temperature and pressure together. The determination of an equation of state for a given fluid or gas has been the subject of a vast amount of literature. For instance, an equation of state such as the one from R. Span and W. Wagner, "A New Equation of State for carbon Dioxide Covering the Fluid Region from the Triple-Point to 1100K at Pressures up to 800 MPa", J. Phys. Chem. Ref Data, 25(6), 1996 may be used for carbon dioxide.

It is also possible to determine physical and thermodynamic properties of the treatment fluid and the gas, $\rho_F$, $\rho_G$, $C_{pG}$, $C_{pF}$, $C_{pG}$, $\eta_F$, $\eta_G$ from experiments. Some of such experiments demonstrate the ability of certain fluids to undergo a temperature change during a JT effect. It is understood that during expansion, a fluid may experience heating, for a negative JT coefficient, or cooling for a positive one, and the scientific and technical literature provides numerous examples of the experimental values of the JT coefficient for numerous fluids. For instance, in J. R. Roebuck, H. Osterberg, "The Joule-Thomson Effect in Nitrogen", *Physical Review,* 48, 1935, and J. R. Roebuck et al, "The Joule-Thomson Effect in Carbon Dioxide", J. Am. Chem. Soc., 64, 1947, the values of the JT coefficient have been measured experimentally for nitrogen, and carbon dioxide, under various conditions in temperature and pressure, and the experimental data reported in these references, respectively, show that the JT coefficient may be positive or negative, highlighting zones of cooling and zones of heating respectively for these fluids.

The method is now illustrated in the case where the treatment fluid is an aqueous acid and the fluid additive is carbon dioxide ($CO_2$). Considering a 15 weight percent hydrochloric acid (15% HCl) solution being pumped with $CO_2$ with a down hole foam quality q equal to 0.5, the down hole injection temperature may be determined using Equations (1) to (7) and by using an equation of state for $CO_2$ as follows. First, and for the purpose of this example, the treatment fluid, 15% HCl, being a liquid, the variations of $\rho_F$, $C_{pF}$, and $\eta_F$, during the flow through the orifices are negligible. The following values are reasonable approximations:

$$\rho_F = 1070\ \text{kg/m}^3, \quad C_{pF} = 4200\ \text{J/(kg F)}, \quad \eta_F = \frac{-1}{\rho_F C_{pF}} = -2.23\times10^{-7}\ \text{K/Pa} \tag{8}$$

For $CO_2$, the determination of $DT_G$ requires computing Equation $$DT_G = \int_{BHP+DP_G}^{BHP} \eta_G(p, T_G)\,dp \tag{6}$$

along the expansion path experienced by the gas. This may be done using numerical approximations as described by Equations (9) to (13) as, typically, the equation of state is a too complex formula to allow the integration in Equation (6) to be done by hand.

$$DT_G = \lim_{N\to\infty}\left[\sum_{i=1,N}\left[\frac{\delta p_N}{C_{pG}(p_i, T_{Gi})}\left(T_{Gi}\frac{\partial v}{\partial T}(p_i, T_{Gi}) - v_G(p_i, T_{Gi})\right)\right]\right] \tag{9}$$

$$v_G(p_i, T_{Gi}) = \frac{1}{\rho_G(p_i, T_{Gi})} \tag{10}$$

$$\delta p_N = \frac{PD}{N} \tag{11}$$

$$p_i = p_{i-1} + \delta p_N \tag{12}$$

$$T_{Gi} = T_{Gi-1} + \left[\frac{\delta p_N}{C_{pG}(p_{i-1}, T_{Gi-1})}\left(T_{Gi-1}\frac{\partial v}{\partial T}(p_{i-1}, T_{Gi-1}) - v_G(p_{i-1}, T_{Gi-1})\right)\right] \tag{13}$$

Equations (9) to (13) can be solved using a large value for N. This large value N may be determined by solving Equations (9) to (13) with increasing values of N until the result does not change significantly when N becomes larger. To solve Equations (9) to (13), it is possible to specify the final value of the pressure during the expansion, bottom hole pressure and the initial temperature in the bottom hole assembly before the expansion, $T_I$.

$$T_{G1} = T_I \tag{14}$$

$$p_N = \text{BHP} \tag{15}$$

Equations (9)-(15) solve the temperature evolution in the gas as it expands by expanding the gas by very small expansion steps and adding the effect of all the smaller steps until the final pressure drop is reached. To be able to do so, the determination of the specific volume $v_G$ must be detailed. This requires the use of an equation of state for $CO_2$. Typically, an equation of state provides an explicit expression of the pressure, given a value of the temperature and specific volume $v_G$:

$$p = \text{EOS}(v_G, T_G) \tag{16}$$

However, determining $v_G$ from the values of p and $T_G$ requires solving a non-linear equation. This may be done easily by using conventional optimization algorithms such as the Newton method or the dichotomy method.

Figure 5:
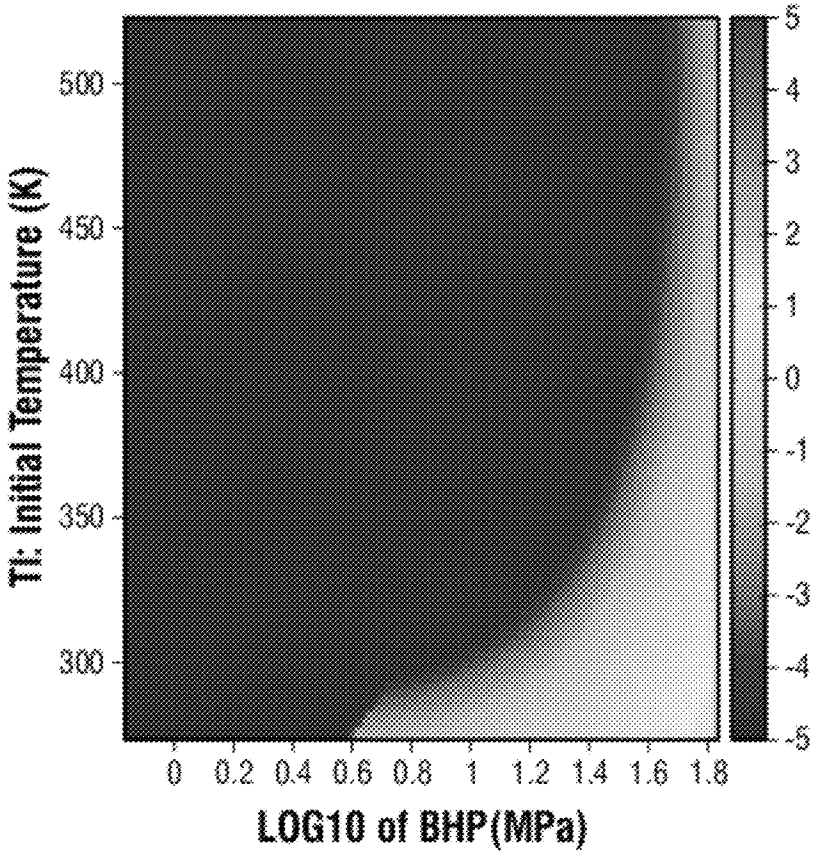
FIG. 5 is a plot of temperature variation in the gas phase as a function of pressure and temperature for carbon dioxide.
Figure 7:
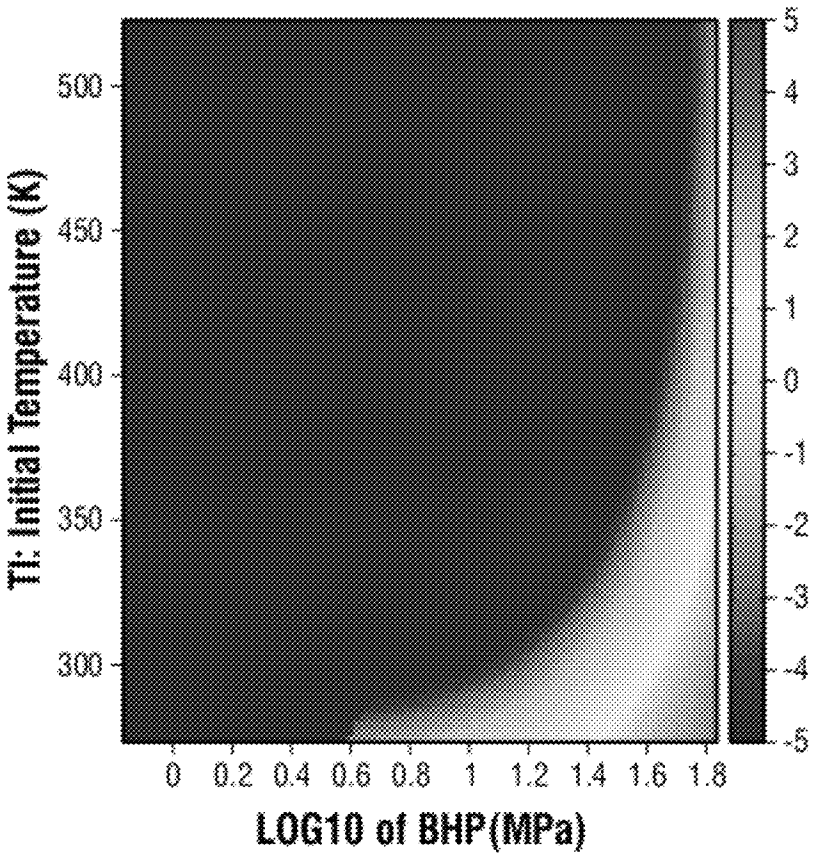
FIG. 7 is a plot of the temperature in the gas phase as a function of pressure and temperature for carbon dioxide.
Figure 8:
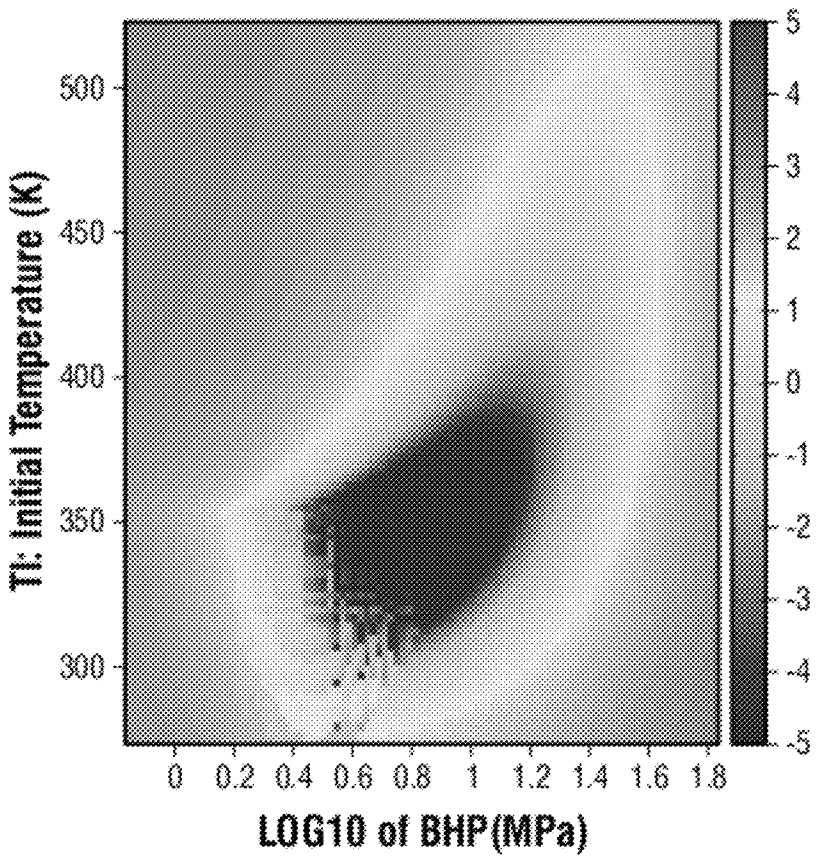
FIG. 8 is a plot of temperature variation of the mixture during the JT effect as a function of pressure and temperature for carbon dioxide.

The problem consisting of solving Equations (9)-(16) has been solved using the equation of state from R. Span and W. Wagner [4]. FIG. 8 illustrate the values of $DT_G$ as a function of the final pressure after expansion (BHP) and the initial temperature before expansion $T_I$. In FIG. 5, the value of $\eta_G$ is plotted for various values of pressure and temperature. The fact that $\eta_G$ is positive over a wide range of pressure and temperature shows that $CO_2$ cools down under the JT effect. Solving Equations (9) to (16), the changes of temperature in the gas ($DT_G$) and in the mixture ($DT_{GF}$) are plotted in FIG. 6 and FIG. 7, respectively, for a value of pressure drop of −1000 PSI. Increasing the pressure drop to −2000 PSI, the fluids cool down further as plotted in FIG. 8 and FIG. 9 but the area affected by the cooling does not vary significantly. It can also be seen that the cooling of the gas is larger than the cooling of the mixture. Depending on the situation, gas alone may therefore be pumped for maximum cooling. It may also be seen that the pressure drop must be large enough for significant cooling to occur. When pressure drop=−100 PSI, the temperature change is much smaller (FIG. 10 and FIG. 11) and therefore, if the engineer aims at cooling down by 5K, the pump rate and the controlled flow device must be controlled in such a way the pressure drop is closer to −1000 PSI.

EXAMPLES

The following examples are presented to illustrate the preparation and properties of fluid systems, and should not be construed to limit the scope of the invention, unless otherwise expressly indicated in the appended claims. All percentages, concentrations, ratios, parts, etc. are by weight unless otherwise noted or apparent from the context of their use.

Figure 4:
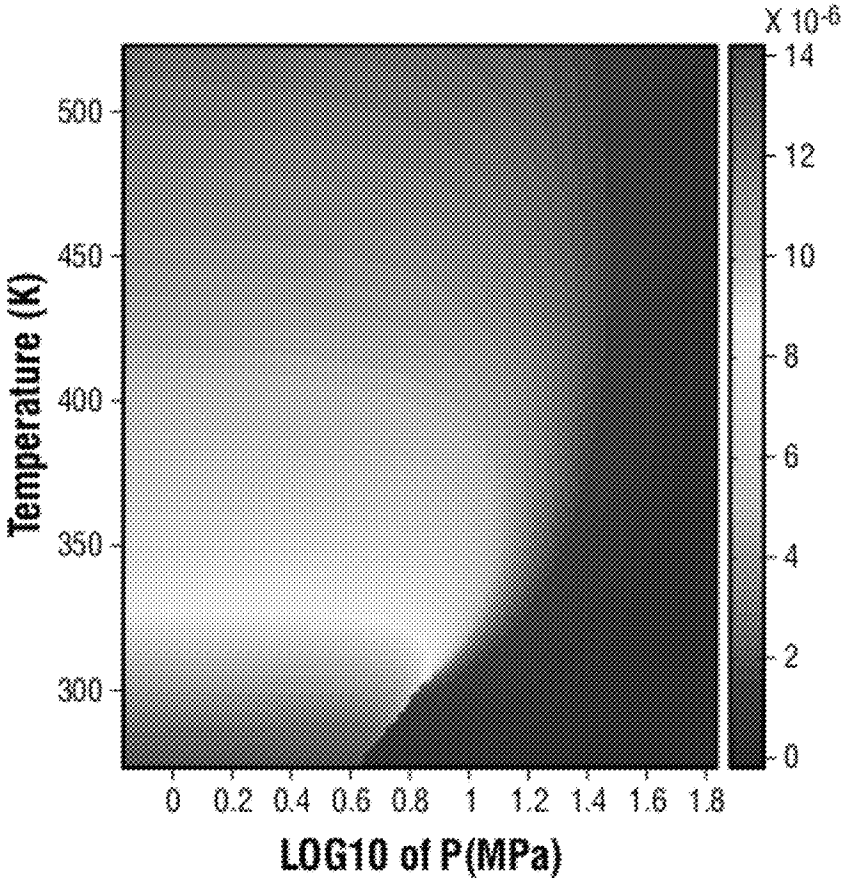
FIG. 4 is a plot of the Joules Thompson coefficient as a function of pressure and temperature for carbon dioxide.

FIG. 4 plots the value of the JT coefficient $\eta_G$ for CO2 as a function of pressure and temperature.

FIG. 5 plots the $DT_G$ for CO2 for various initial temperature $T_I$ and pressure after JT effect (BHP) with a PD equal to −1000 PSI. Data truncated between −5K and +5K.

Figure 6:
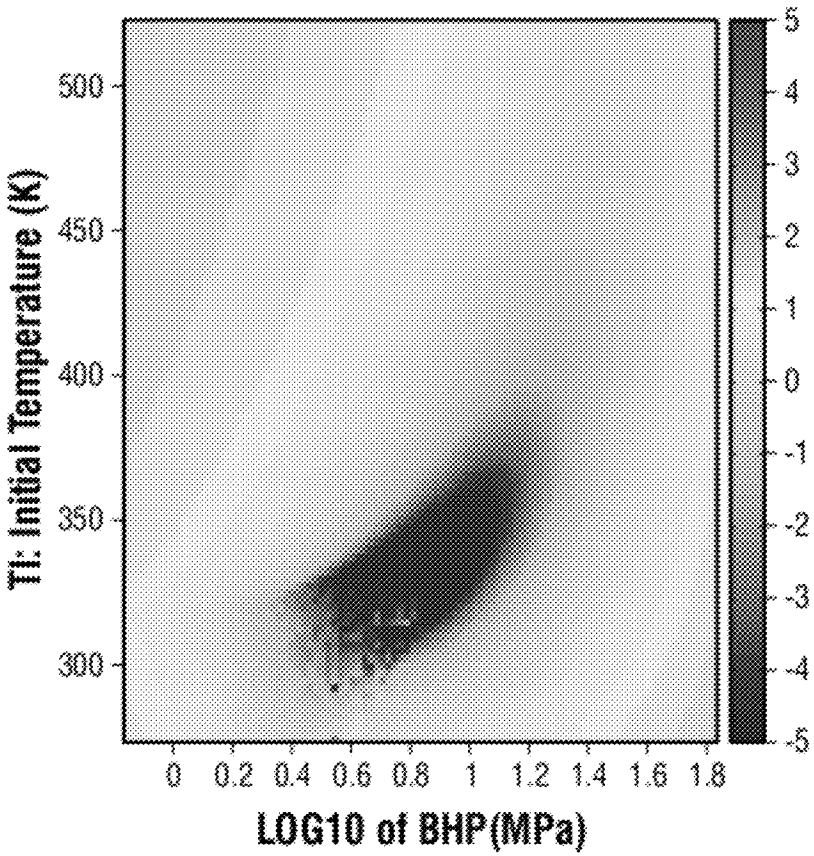
FIG. 6 is a plot of temperature variation of the mixture during the Joule Thomson (JT) effect as a function of pressure and temperature for carbon dioxide.
Figure 9:
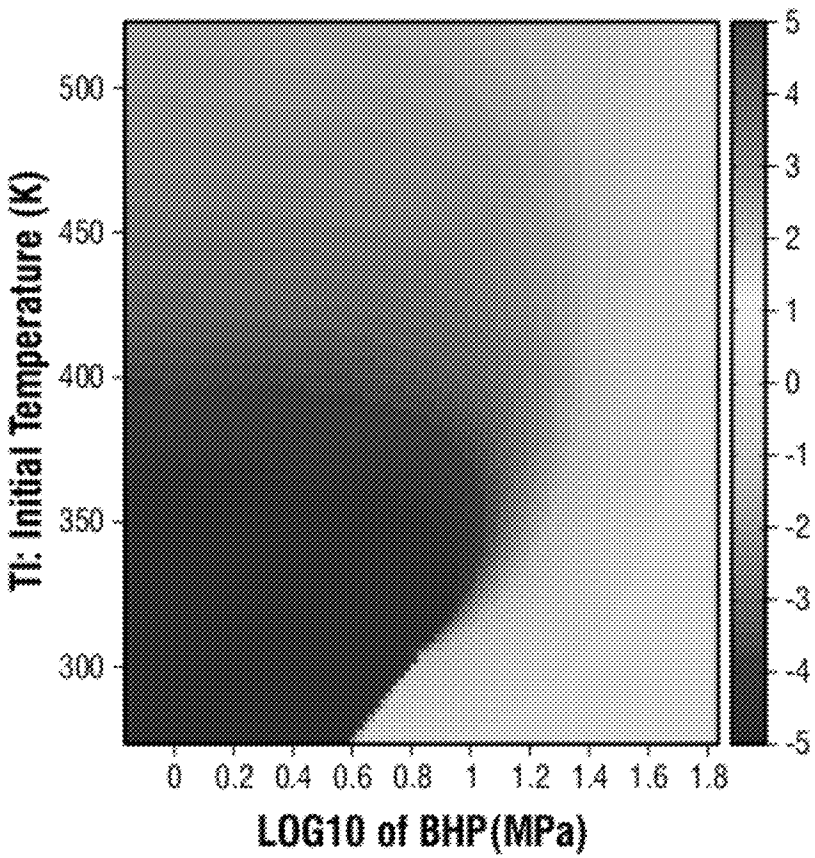
FIG. 9 is a plot of the temperature in the gas phase as a function of pressure and temperature for carbon dioxide.
Figure 10:
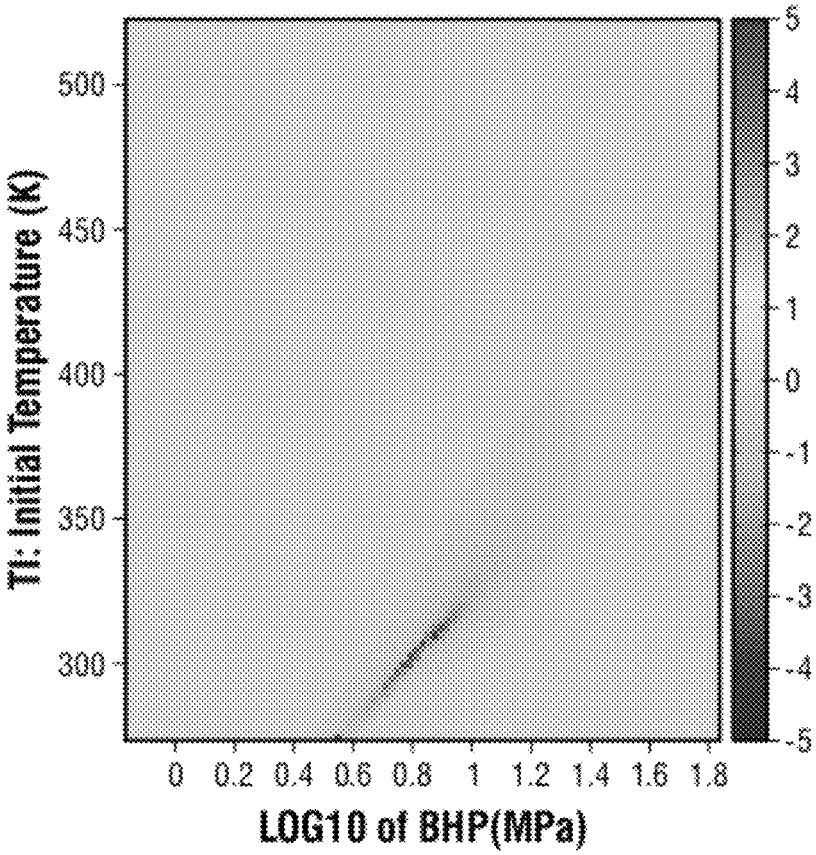
FIG. 10 is a plot of temperature variation of the mixture during the JT effect as a function of pressure and temperature for carbon dioxide.

FIG. 6 is a plot of $DT_{GF}$ for CO2 for various initial temperature $T_I$ and pressure after JT effect (BHP) with a PD equal to −1000 PSI. Data truncated between −5K and +5K. FIG. 7 is a plot of $DT_G$ for CO2 for various initial temperature $T_I$ and pressure after JT effect (BHP) with a PD equal to −2000 PSI. FIG. 8 is a plot of Data truncated between −5K and +5K. FIG. 8 plots $DT_{GF}$ for CO2 for various initial temperature $T_I$ and pressure after JT effect (BHP) with a PD equal to −2000 PSI. Data truncated between −5K and +5K. FIG. 9 is a plot of $DT_G$ for CO2 for various initial temperature $T_I$ and pressure after JT effect (BHP) with a PD equal to −100 PSI. Data truncated between −5K and +5K. FIG. 10 is a plot of $DT_{GF}$ for CO2 for various initial temperature $T_I$ and pressure after JT effect (BHP) with a PD equal to −100 PSI. Data truncated between −5K and +5K The particular embodiments disclosed above are illustrative only, as the invention may be modified and practiced in different but equivalent manners apparent to those skilled in the art having the benefit of the teachings herein. Furthermore, no limitations are intended to the details herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of using a fluid within a subterranean formation, comprising:

forming a fluid comprising a fluid additive;

introducing the fluid to a formation using a bottom hole assembly, the bottom hole assembly comprising at least one valve and at least one temperature sensor;

observing a downhole fluid injection temperature; and controlling a rate of fluid introduction using the observed downhole fluid injection temperature in order to meet a required downhole fluid injection temperature and thereby increase the efficiency and performance of the fluid in a downhole operation, wherein controlling comprises at least opening or closing the at least one valve on the bottom hole assembly.

2. The method of claim 1, wherein the controlling the rate of fluid introduction comprises controlling a volume of the fluid additive.

3. The method of claim 1, wherein the fluid additive comprises nitrogen or carbon dioxide or both.

4. The method of claim 1, wherein the observing a temperature comprises obtaining a signal from the temperature sensor on the bottom hole assembly.

5. The method of claim 1, wherein the controlling a rate of fluid introduction comprises using a model based on pressure and temperature properties of the fluid additive.

6. The method of claim 1, wherein the introducing the fluid comprises using a pump.

7. The method of claim 6, wherein the controlling a rate of fluid introduction comprises sending a signal to the pump.

8. The method of claim 1, wherein controlling comprises controlling at least one property of the fluid by a controlled use of a Joule Thomson effect of the fluid to meet the required the downhole injection temperature.

9. The method of claim 1 wherein controlling the downhole injection temperature increases a functionality of the injected fluid.

10. The method of claim 1, wherein controlling the downhole injection temperature optimizes downhole measurements used for interpreting a performance of the injected fluid.

11. An apparatus to deliver fluid to a subterranean formation, comprising:

a pump configured to deliver fluid to a wellbore;

a flow path configured to receive fluid from the pump;

a bottom hole assembly comprising a fluid outlet and a temperature sensor and configured to receive fluid from the flow path, the temperature sensor configured to measure a downhole injection temperature of the fluid; and a controller configured to accept information from the temperature sensor and to send a signal to the pump or the bottom hole assembly to control operation of the pump, the fluid outlet, and the bottom hole assembly to maintain a required downhole injection temperature of the fluid through the use of a Joule Thomson effect.

12. The apparatus of claim 11, wherein the bottom hole assembly further comprises valves.

13. The apparatus of claim 12, wherein the valves are configured to receive a signal from the controller.

14. The apparatus of claim 11, further comprising a fluid tank and an additive tank configured to deliver fluid to the pump.

15. The apparatus of claim 14, wherein a flow of the fluid from the fluid tank and the additive tank is controlled by a signal from the controller.

16. A method of using a fluid within a subterranean formation, comprising:

forming a fluid comprising a fluid additive, the fluid formed by a mixture of a treatment fluid and a fluid additive;

pumping the fluid to a formation with a pump, a flow path, and a bottom hole assembly;

observing a downhole fluid injection temperature with a temperature sensor;

sending a signal from the temperature sensor to a controller; and sending a signal from the controller to the pump to control operation of the pump, to control operation of the bottom hole assembly, and to control a proportion of the mixed treatment fluid and fluid additive to change the downhole fluid injection temperature through the use of a Joule Thomson effect and thereby control the functionality of the fluid.

17. The method of claim 16, wherein the bottom hole assembly comprises a valve.

18. The method of claim 17, further comprising sending a signal from the controller to the valve.

* * * * *